US008488997B2

(12) United States Patent
Adachi et al.

(10) Patent No.: US 8,488,997 B2
(45) Date of Patent: Jul. 16, 2013

(54) IMAGE FORMING APPARATUS CONTROLLING STANDBY POSITIONS OF DEVELOPING DEVICES

(75) Inventors: Motoki Adachi, Ashigarakami-gun (JP); Shuhei Kawasaki, Mishima (JP); Yuji Kawaguchi, Mishima (JP); Masanori Tanaka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 287 days.

(21) Appl. No.: 12/722,975

(22) Filed: Mar. 12, 2010

(65) Prior Publication Data

US 2010/0239289 A1 Sep. 23, 2010

(30) Foreign Application Priority Data

Mar. 17, 2009 (JP) ..... 2009-064678
Feb. 24, 2010 (JP) ..... 2010-039004

(51) Int. Cl.
*G03G 15/01* (2006.01)

(52) U.S. Cl.
USPC ..... 399/227; 399/53; 399/54; 399/226; 399/228

(58) Field of Classification Search
USPC ..... 399/53, 54, 226, 227, 228
See application file for complete search history.

(56) References Cited

U.S. PATENT DOCUMENTS 6,701,110 B2 * 3/2004 Ono ..... 399/226
6,931,221 B2 * 8/2005 Ono ..... 399/226

FOREIGN PATENT DOCUMENTS

JP 10-268606 10/1998
JP 2005-003865 1/2005

* cited by examiner

*Primary Examiner* — Ryan Walsh
(74) *Attorney, Agent, or Firm* — Canon USA Inc. IP Division

(57) ABSTRACT

In an image forming apparatus of a rotary type, when a pause is made during continuous image formation, the time taken to restart image formation after the pause is shortened so as to reduce stress on the user. In the image forming apparatus, it is determined beforehand whether the next image formation mode is a color mode or a mono mode, and a developing device to be first used in the next image formation mode is moved to a developing standby position.

5 Claims, 10 Drawing Sheets

IMAGE FORMING APPARATUS CONTROLLING STANDBY POSITIONS OF DEVELOPING DEVICES

BACKGROUND OF THE INVENTION

1. Field of the Invention

The present invention relates to an electrophotographic color image forming apparatus using a plurality of developing devices.

2. Description of the Related Art

As full-color image forming apparatuses, image forming apparatuses of a rotary type in which a plurality of developing devices are supported by a rotating support body (rotary) are known. In an image forming apparatus of this rotary type, one of the developing devices is placed at a position opposing a photosensitive member (developing position) by rotating the rotary in a predetermined direction, and develops a latent image on the photosensitive member into a visible toner image. The toner image is then transferred onto an intermediate transfer medium. By repeating these operations while rotating the rotary and sequentially switching among the developing devices, toner images of a plurality of colors are superimposed to form a color image. When formation of the color image is completed, the rotary returns to a preset standby position and stands by until the next image signal is given.

It is known that the above-described full-color image forming apparatus is operable in a multicolor mode (color mode) in which an image is formed in full color (yellow, magenta, cyan, and black) and a monochromatic mode (mono mode) in which an image is formed in a single color (black). In a color mode, development is sequentially performed in yellow, magenta, cyan, and black colors in this order while rotating the rotary in a predetermined direction. By thus repeating image forming operations, such as development and transfer, a plurality of times, a color image is formed. When image formation is performed in a mono mode, only the black developing device is moved to the developing position, while the developing devices for the other colors are not moved to the developing position and do not perform development. This makes the image forming speed higher than in the color mode. Moreover, it is possible to suppress wear of the development devices that are not used.

Japanese Patent Laid-Open No. 2005-003865 discloses an apparatus that is used as a monochromatic image forming apparatus when a developing-agent container is loaded in one of a plurality of loading/unloading portions, and as a color image forming apparatus when a plurality of developing-agent containers are loaded in the loading/unloading portions. The home position of a rotating body adopted when the image forming apparatus is used as the monochromatic image forming apparatus is different from that adopted when the image forming apparatus is used as the color image forming apparatus.

With recent diversification of users, image formation has been performed in various image patterns and with various types and sizes of paper. To respond to such image formation, it is known that image formation is interrupted by a special operation at a predetermined timing even during continuous printing. When such a special operation is performed, a developing operation is, of course, stopped temporarily. In this case, the rotary waits for start of the next image formation at a developing standby position where the developing device is away from the developing position.

When image formation is interrupted and the rotary is set at the developing standby position in the above-described image forming apparatus, much time may be taken to rotate the developing device to the developing position in the next image forming operation, depending on the developing standby position. For example, in a case in which the yellow developing device stands by at a position near the developing position, when the next image forming operation is to be performed in a mono mode, much time is taken to move the black developing device to the developing position. In the apparatus disclosed in Japanese Patent Laid-Open NO. 2005-003865, the home position is changed in accordance with the number of developing-agent containers loaded in the loading/unloading portions. Therefore, when the developing operation is interrupted during image formation in a state in which the developing-agent containers are loaded in a plurality of loading/unloading portions, it is difficult to change the home position.

SUMMARY OF THE INVENTION

The present invention provides an image forming apparatus that suppresses a decrease in the image forming speed by decreasing the distance for which developing devices are moved by rotation of a rotary, depending on whether image formation is performed in a mono mode or a color mode.

According to the present invention, it is determined beforehand which of a mono mode and a color mode is used as the next image formation mode, and a developing standby position is appropriately set in accordance with the mode. This reduces the time taken to start the next image formation. As a result, a decrease in the imaging forming speed can be suppressed.

Further features of the present invention will become apparent from the following description of exemplary embodiments with reference to the attached drawings.

DESCRIPTION OF THE EMBODIMENTS

Figure 1:
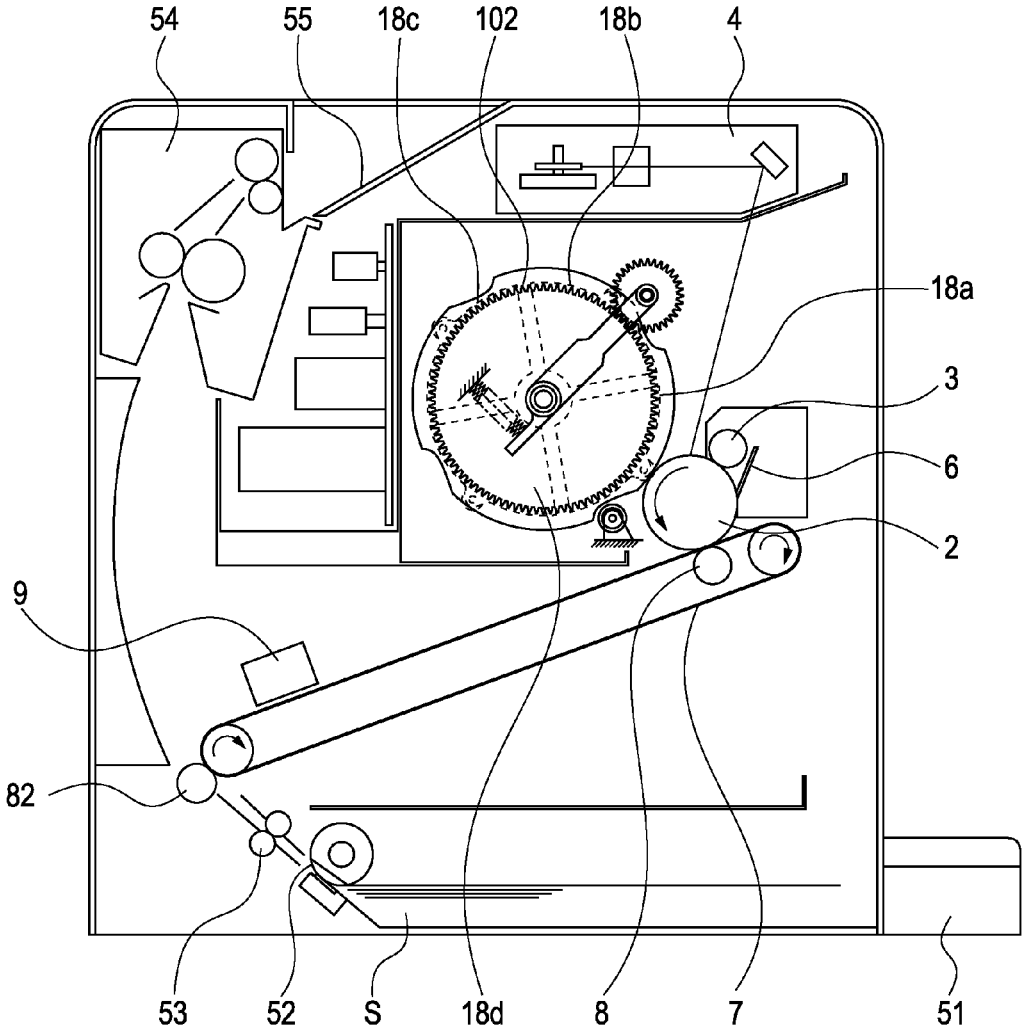
FIG. 1 is a schematic sectional view of an image forming apparatus according to an embodiment of the present invention.

FIG. 1 is a schematic sectional view illustrating a configuration of a color laser beam printer according to an embodiment.

First, a description will be given of an image forming operation of this color laser beam printer. Referring to FIG. 1, the color laser beam printer includes a photosensitive drum (image bearing member) 2. Around the photosensitive drum 2, the following components are arranged: A charging roller 3 uniformly charges the photosensitive drum 2. An exposure device 4 forms a latent image on the photosensitive drum 2 by irradiation of laser light. Developing devices 18*a* to 18*d* develop latent images formed on the photosensitive drum 2 with corresponding color (yellow, magenta, cyan, and black) toners into visible images. A cleaning device 6 removes residual toner from the photosensitive drum 2.

Figure 10:
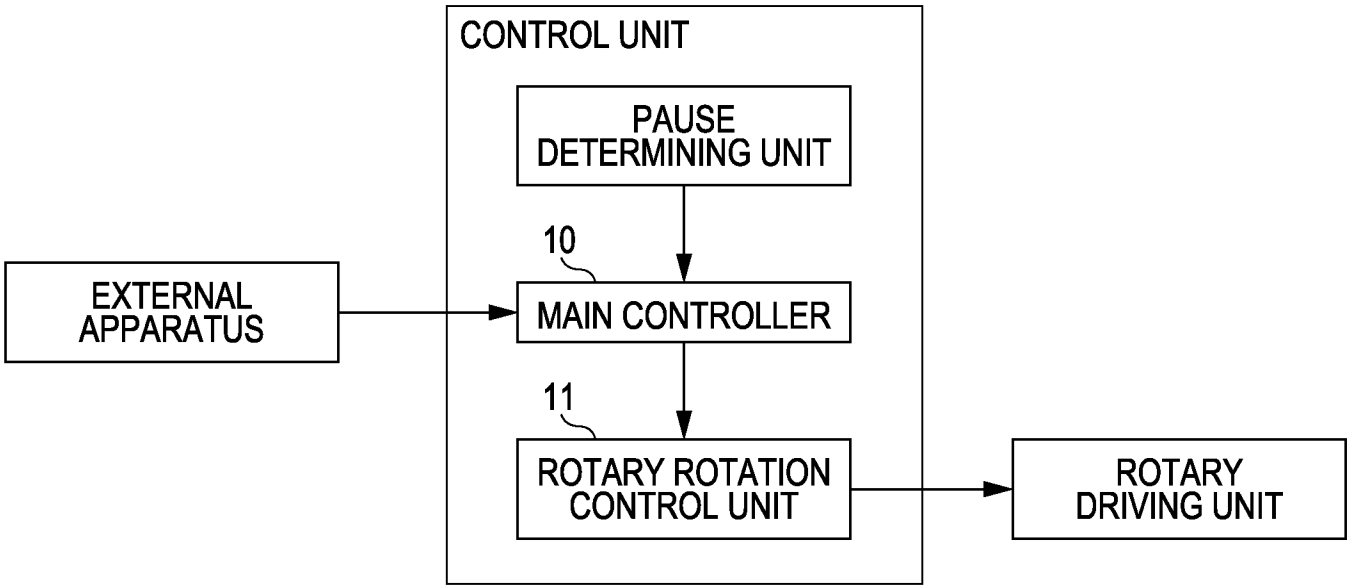
FIG. 10 is a control block diagram of the embodiment.

A rotary (developing-device support body) 102 can rotate while supporting a plurality of developing devices. By the rotation of the rotary 102, the developing devices can be moved between a developing position to perform development and a developing standby position just before development. The rotation of the rotary 102 is controlled by a rotary rotation control unit 11 (FIG. 10).

To form a color image, first, the photosensitive drum 2 is rotated in a direction of arrow in FIG. 1 (counterclockwise) in synchronization with rotation of an intermediate transfer belt 7. Then, a surface of the photosensitive drum 2 is uniformly charged by the charging roller 3, and is irradiated with light for a yellow image by the exposure device 4, thereby forming a yellow electrostatic latent image on the photosensitive drum 2.

Before the electrostatic latent image is formed, the rotary 102 is rotated to move the yellow developing device 18*a* to the developing position opposing the photosensitive drum 2.

At the developing position, a developing roller (developing-agent bearing member) 182 (FIG. 7) in the developing device is rotated in contact with the photosensitive drum 2. A voltage having the same polarity as that of the yellow toner is applied to the developing roller 182, so that the electrostatic latent image on the photosensitive drum 2 is developed with the yellow toner.

After that, a voltage having a polarity opposite that of the yellow toner is applied to a primary transfer roller 8 provided in the intermediate transfer belt 7, so that the yellow toner image on the photosensitive drum 2 is primarily transferred onto the intermediate transfer belt 7.

When primary transfer of the yellow toner image is completed, as described above, the developing devices 18*b* to 18*d* for magenta, cyan, and black colors are sequentially rotated by the rotary 102, and placed at the developing position opposing the photosensitive drum 2. After that, similarly to the development of the yellow image, formation of an electrostatic latent image, development, and primary transfer are sequentially performed for each of the magenta, cyan, and black colors, and four color toner images are thereby superimposed on the intermediate transfer belt 7.

During this, a secondary transfer roller 82 is not in contact with the intermediate transfer belt 7. Further, a cleaning unit 9 for cleaning the intermediate transfer belt 7 of secondarily transferred toner is also not in contact with the intermediate transfer belt 7.

On the other hand, sheets S serving as transfer materials are stacked in a sheet supply cassette 51 provided at the bottom of the apparatus, and are separated and supplied one by one from the sheet supply cassette 51 to a pair of registration rollers 53 by a sheet supply roller 52. The registration rollers 53 feed a supplied sheet S into between the intermediate transfer belt 7 and the secondary transfer roller 82. In this case, the secondary transfer roller 82 is in pressing contact with the intermediate transfer belt 7 (state shown in FIG. 1).

A voltage having a polarity opposite the polarity of the toner is applied to the secondary transfer roller 82, and the four color toner images superimposed on the intermediate transfer belt 7 are secondarily transferred together onto a surface of the conveyed sheet S.

The sheet S is conveyed to a fixing device 54 after the toner image is transferred thereon. The fixing device 54 hot-presses the sheet S, so that the toner image is fixed on the sheet S. As a result, a color image is formed on the sheet S, and this sheet S is output from the fixing device 54 to an output portion of an upper cover 55 provided outside the apparatus.

The image forming apparatus of the embodiment is operable in a color mode (multicolor mode) in which a color image is formed in a plurality of colors, as described above), and a mono mode (monochromatic mode) in which an image is formed only in a single color (e.g., black).

In a mono mode, image formation is performed only with the black developing device (first developing device). In a color mode, after development is performed with at least one of the yellow, magenta, and cyan developing devices (second developing device), development is performed with the black developing device for the following reason: If a black image is first developed and primarily transferred onto the intermediate transfer belt and the other color images are then developed and primarily transferred on the black image, when all the images are secondarily transferred onto paper, the black image is at the top. When fixing is performed in this state, the black color covers the other colors, and the influence of the black color increases. This reduces the other color hues, and it is difficult to reproduce a desired color. For this reason, a black image is finally developed in the color mode.

In the mono mode, similarly to the color mode, a latent image is formed by charging and exposure. Subsequently, the latent image is developed only by the black developing device, is primarily transferred onto the intermediate transfer belt, and is then secondarily transferred onto a conveyed sheet. A major difference of the mono mode from the color mode is that sequential switching among the developing devices is not made by the rotary. Hence, the image output speed in the mono mode can be four times the speed in the color mode.

In the image forming apparatus of the embodiment, an image signal is given from an external apparatus, such as a host computer, to a main controller 10 in a control unit (FIG. 10), and the main controller 10 determines before image formation which of a mono mode and a color mode is to be performed. According to the determined mode, the main controller 10 controls sections of the engine. When a command is given from the main controller 10 during the previous image forming operation, the engine does not perform post-rotation, and continues image formation without stopping.

With recent diversification of users, a plurality of image forming jobs in which color printing and monochromatic printing are mixed are often performed. For this reason, switching from a color mode to a mono mode or from a mono mode to a color mode is frequently made during continuous printing.

Now, a detailed description will be given of the motion of the rotary 102 that is the principal part of the embodiment.

Figure 2:
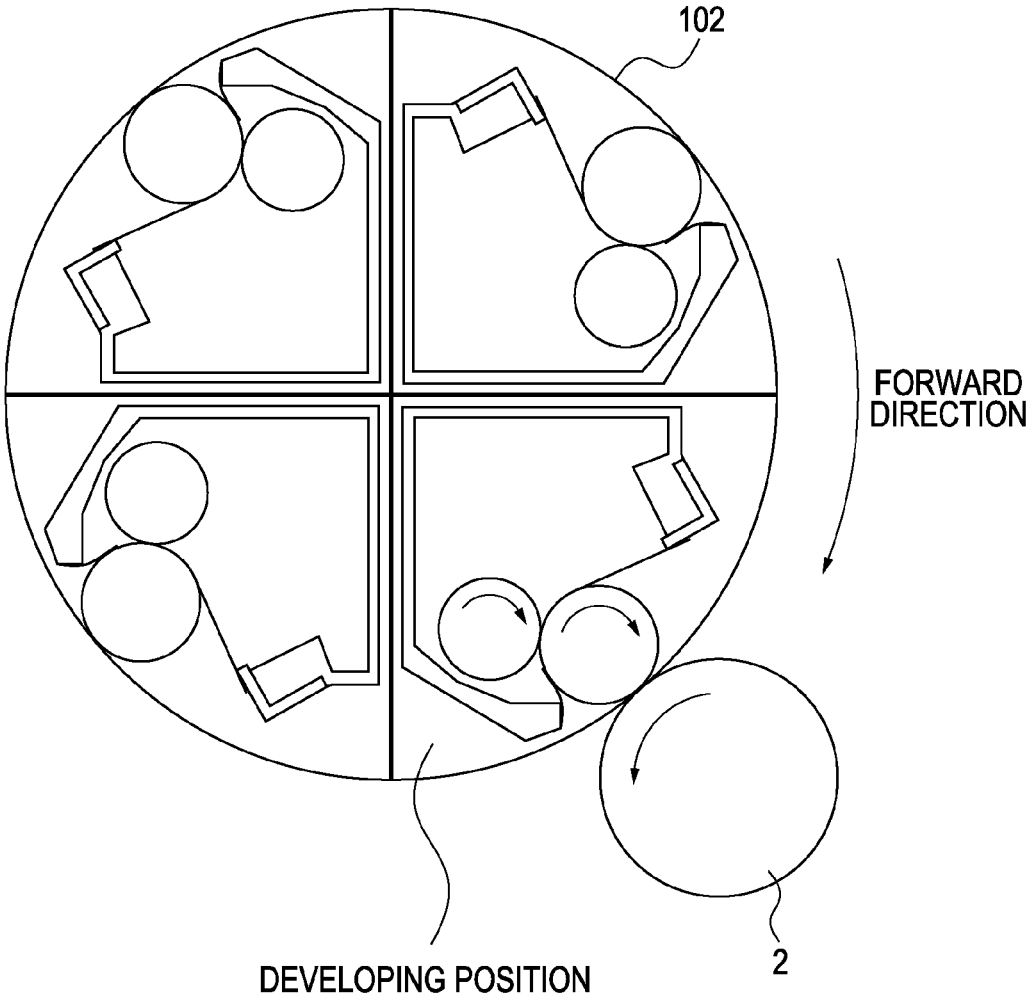
FIG. 2 is a schematic sectional view of a rotary in which a developing device is at a developing position.

As shown by the arrow in FIG. 2, the rotary 102 rotates relative to the photosensitive drum 2 from above, thereby moving the developing device to the developing position. Here, the rotation of the rotary 102 in this direction (forward direction) is referred to as forward rotation. During color image formation, the rotary 102 makes forward rotation to move the developing devices 18.

Figure 3A:
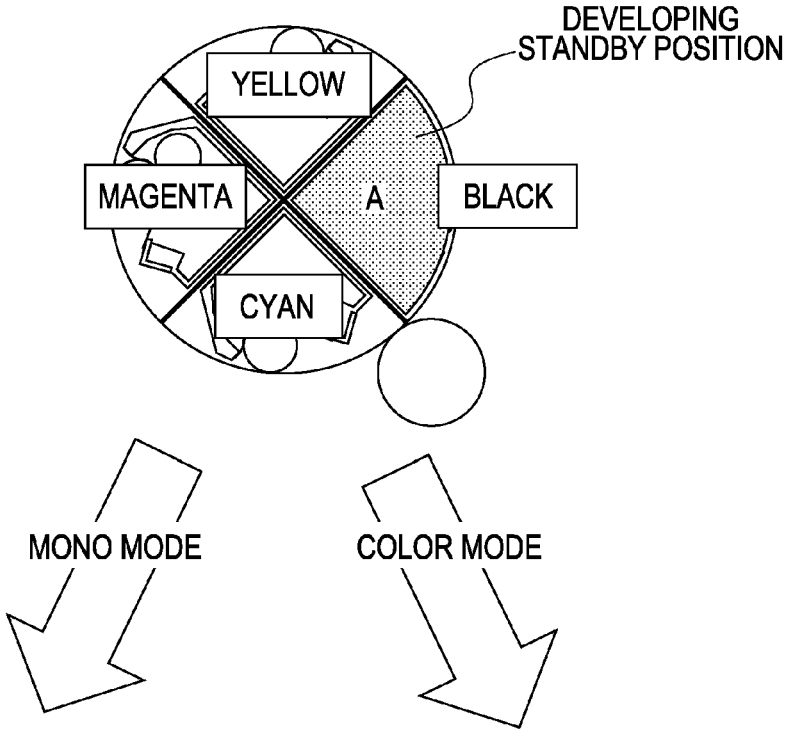
FIGS. 3A to 3C are schematic sectional views illustrating motion of the rotary made from a standby state at the beginning of image formation.
Figure 3B:
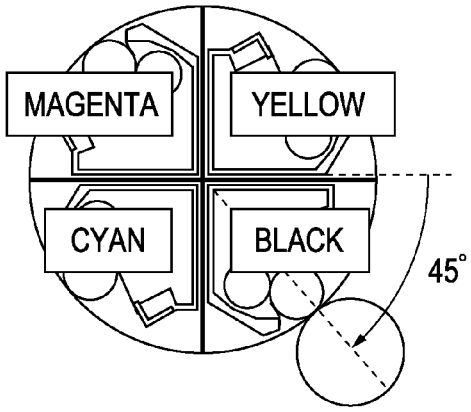
Figure 3C:
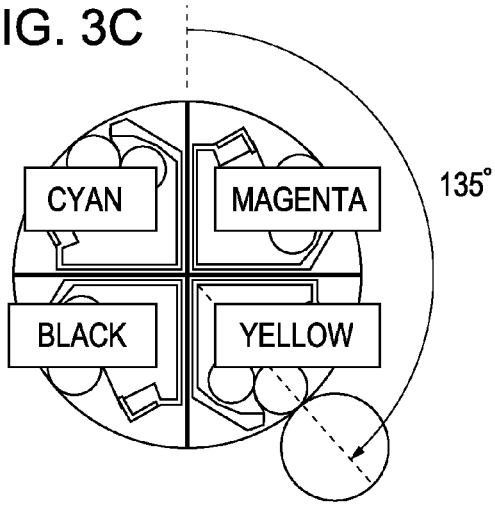

When image formation is not performed, the rotary 102 is in a standby position where none of the developing devices 18 are at the developing position, as shown in FIG. 3A. In this state, driving force is not transmitted to any of the developing devices 18. In this case, a standby position A just before the developing position is referred to as a developing standby position. The developing standby position is provided between a position where a certain developing device is placed at the developing position and a position where a developing device that performs the next image formation is placed when the certain developing device is at the developing position. The developing standby position will be described with reference to FIGS. 3A and 3B. Referring to FIG. 3B, when the black developing device is at the developing position, a developing device that performs the next image formation is the yellow developing device. A position between the black developing device and the yellow developing device in FIG. 3B serves as a developing standby position (see FIG. 3A). The developing standby position and the developing position are spaced about 45° apart. In the embodiment, the developing device at the developing standby position is a developing device containing black toner. This is because the black developing device can be quickly moved to the developing position when the next image formation is performed in a mono mode (FIG. 3B). Further, even if the next image formation is performed in a color mode, the developing device for yellow that is the first color in the color mode can be moved to the developing position by being rotated forward about 135° (FIG. 3C). This reduces rotation loss.

Figure 4:
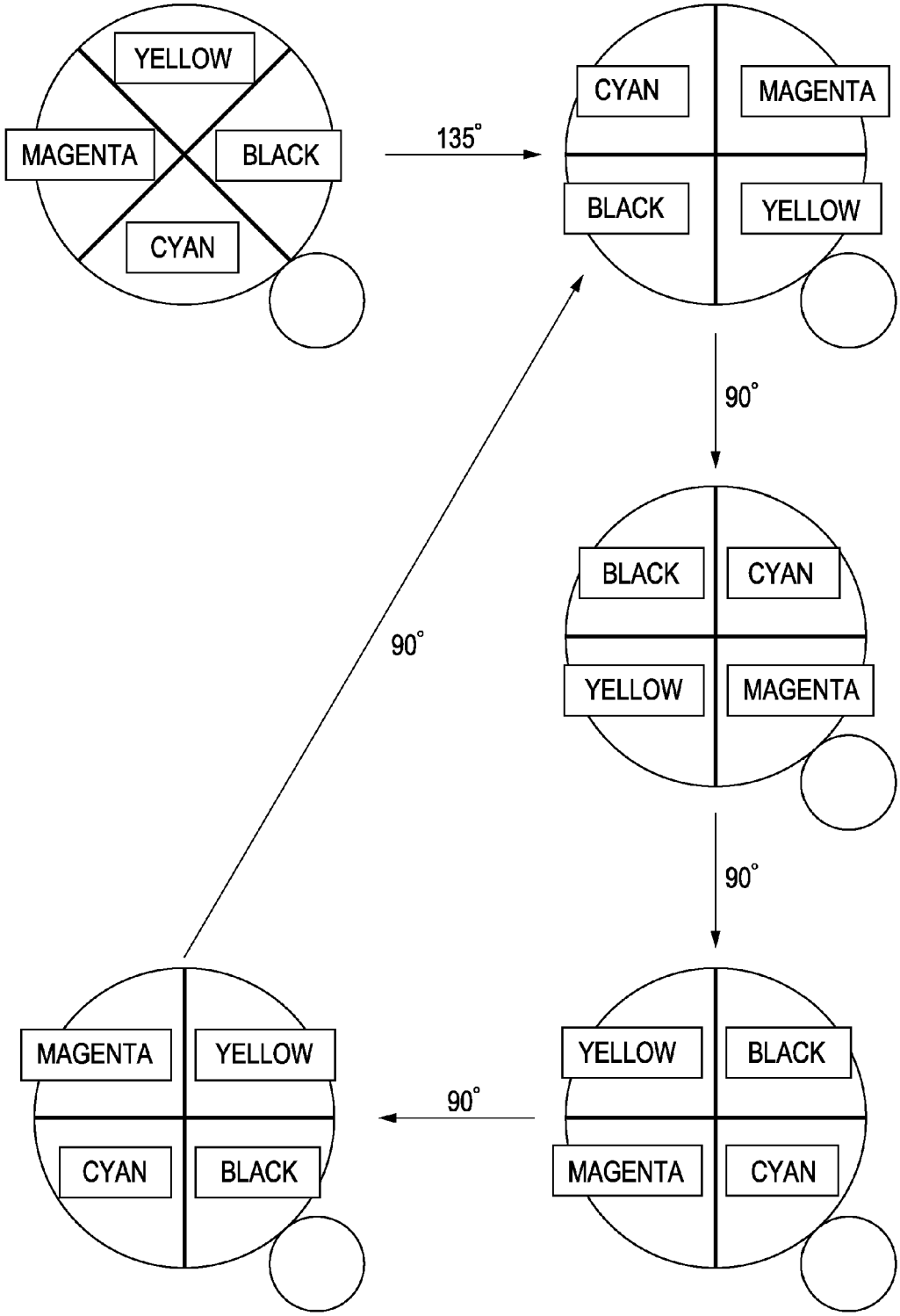
FIG. 4 is a schematic sectional view illustrating motion of the rotary in a color mode.

In a color mode, the rotary 102 is first rotated forward 135° to move the yellow developing device to the developing position, where developing is performed, as shown in FIG. 4. After that, the rotary 102 is sequentially rotated forward 90° to move each of the magenta, cyan, and black developing devices in this order to the developing position, where development is performed. To continuously perform image formation in a color mode, a black image is first developed, and the rotary 102 is then rotated forward 90° to move the yellow developing device to the developing position, where a yellow image is developed. Subsequently, similarly to the above, magenta, cyan, and black images are developed. When a command to perform the next image formation is not given, the black developing device is moved to the developing standby position after black development is completed.

Figure 5:
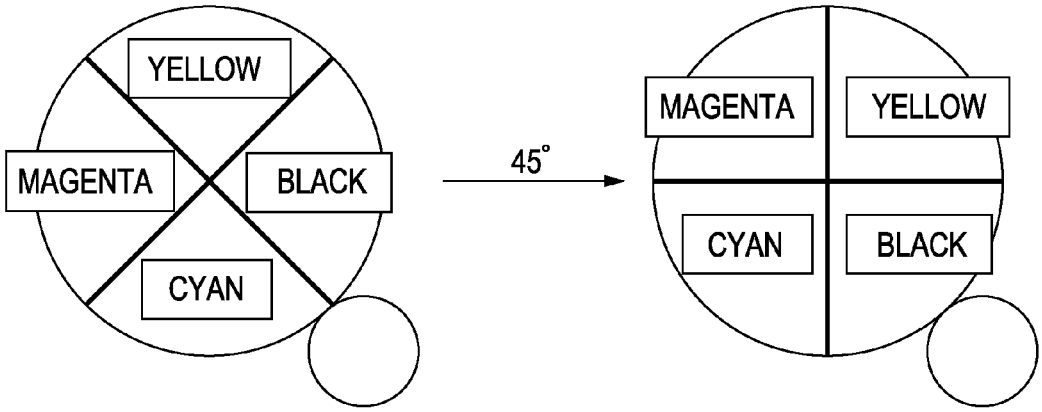
FIG. 5 is a schematic sectional view illustrating motion of the rotary in a mono mode.

In a mono mode, the rotary 102 is first rotated forward 45° to move the black developing device to the developing position, where development is performed, as shown in FIG. 5. During continuous printing (while images are formed continuously), the rotary 102 does not switch among the developing devices so that the black developing device still remains at the developing position. When a command to perform the next image formation is not given, after black development is completed, the black developing device is moved to the developing standby position.

To switch from a color mode to a mono mode during continuous printing, after development of black, which is the final color in the color mode, is completed, the color mode is switched to the next mono mode in a state in which the black developing device still remains at the developing position. Further, to switch from a mono mode to a color mode, after development of black is completed, the rotary 102 is rotated 90° so as to move the developing device for yellow, which is the first color in the color mode, to the developing position. By switching between the color mode and the mono mode in this way, image formation can be performed without any loss in image output speed.

With recent diversification of users, the number of types of output images and the number of sizes of paper for image formation have increased. To respond this diversification of the users, a special operation is sometimes performed even during continuous printing so as to optimize the fixing temperature and to clean the intermediate transfer belt. Such a state in which a special operation is inserted and image formation is stopped is referred to as a pause. For example, optimization of the fixing temperature is an operation in which, when the detected fixing temperature does not reach a desired value suitable for fixing, image formation is temporarily stopped until the temperature does not reach the desired value. Cleaning of the intermediate transfer belt is an operation in which, when the cumulative print ratio reaches a predetermined value, the intermediate transfer belt is driven in a state in which image formation is not performed (toner is not transferred) in order to remove the toner remaining on the intermediate transfer belt. By causing the intermediate transfer belt to make several turns, the toner can be removed therefrom. A pause determining unit in the control unit determines whether to make a pause (FIG. 10).

During this pause, it is necessary to move the developing device away from the developing position in order to suppress unnecessary wear of the developing device.

Further, it is also necessary to minimize the pause time in order to prevent the user from feeling stress.

Accordingly, the present invention aims to reduce the pause time by minimizing the rotation time of the rotary, and exerts the following control:

More specifically, during a pause (image formation is stopped during continuous image formation), the rotary control unit changes the developing device to be moved to the developing standby position, depending on whether the next image formation is restarted in a mono mode or a color-mode after the pause. When the next image formation is performed in a mono mode, the black developing device (first developing device) is moved to the developing standby position. In contrast, when the next image formation is performed in a color mode, the yellow developing device (second developing device) is moved to the developing standby position. In this way, the rotation control unit controls rotation of the rotary.

A method for controlling the rotation of the rotary during a pause will be described in detail below.

To control the rotary, first, the main controller determines the next image formation mode beforehand, at the latest, by completion of development of the final color (black) in image formation immediately before the pause. Then, the developing device to be first used in the next image formation is moved to the developing standby position. This allows a desired developing device to be quickly moved to the developing position when image formation is restarted after the pause.

Figure 6A:
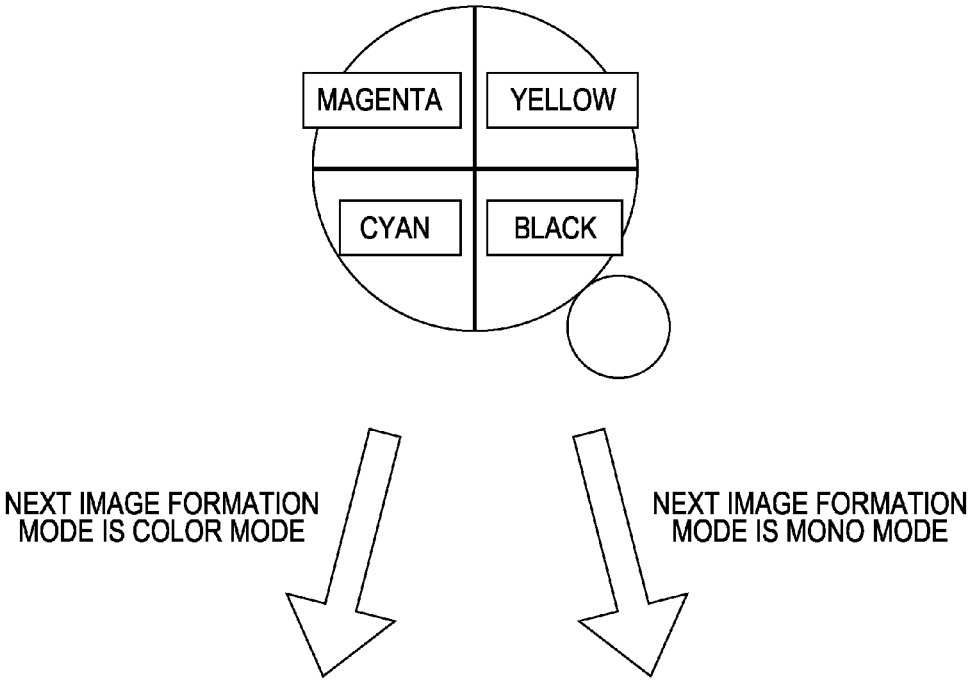
FIGS. 6A to 6C are schematic sectional views illustrating motion of the rotary made at a pause.
Figure 6B:
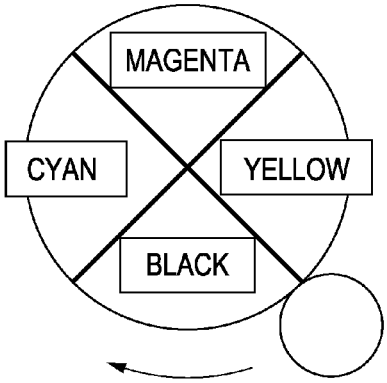
Figure 6C:
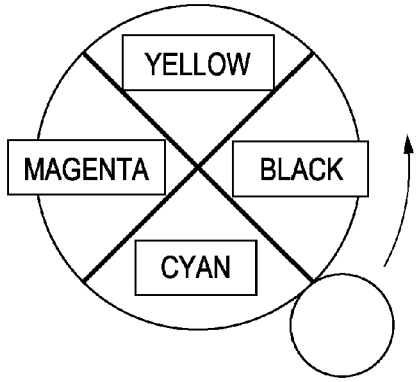

Next, a description will be given of a method of movement to the developing standby position. The rotary 102 is rotatable in forward and reverse directions. In order to reduce the rotation amount of the rotary 102 for moving the developing device to the developing standby position, forward rotation and reverse rotation are switched. FIG. 6A illustrates the position of the rotary 102 immediately before a pause. When image formation is performed in a color mode after a pause, the rotary 102 is rotated forward 45° so that the yellow developing device stands by at the developing standby position, as shown in FIG. 6B. In contrast, when the next image formation is performed in a mono mode, the rotary 102 is rotated in a direction opposite the forward direction (reverse direction) 45° so as to move the black developing device to the developing standby position, as shown in FIG. 6C. In this way, the developing device to be moved to the developing standby position is changed in accordance with the next mode. Further, this rotation control of the rotary allows the developing device to be used next to be moved to the developing standby position in the shortest distance, and this can shorten the time necessary for movement to the developing standby position.

By thus minimizing the rotation time of the rotary, the pause time can be shortened.

A structure of the related art that does not have a function of determining the next image formation mode will be considered. If the function of determining the next image formation mode is not provided, the black developing device or the developing device to be first used in a color mode is moved to the developing standby position during a standby state of the rotary. In this case, when the black developing device is moved to the developing standby position, if the next image formation is restarted in a color mode after a pause, it is necessary to rotate the rotary forward 135°. Conversely, when the developing device to be first used in a color mode is moved to the developing standby position, if the next image formation is restarted in a mono mode after a pause, it is necessary to rotate the rotary forward 315°. This increases the time taken until image formation is restarted after the pause.

Further, a consideration will be given to a structure which does not have a function of determining the next image formation mode and in which the rotary is rotatable only forward.

Assuming that a pause is made in a state in which the black developing device is at the developing position, if the function of determining the next image formation mode is not provided, the black developing device or the developing device to be first used in a color mode is moved to the developing standby position in a standby state of the rotary. To move the black developing device to the developing standby position, it is necessary to rotate the rotary forward 315°. Conversely, when the developing device to be first used in the color mode is moved to the developing standby position, the amount of rotation of the rotary made to move the developing device to the developing standby position is small. However, when the next image formation is performed in a mono mode, it is also necessary to rotate the rotary forward 315° at a restart of image formation. In this way, considerable loss of time occurs.

These factors increase the pause time, and impose stress on the user.

FIG. 10 is a control block diagram of the embodiment. Referring to FIG. 10, an image signal sent from an external apparatus is detected by a main controller 10 (mode determining unit) in a control unit. When a pause determining unit in the control unit determines that a pause is necessary, it makes a pause. When a pause is made, the main controller 10 determines whether image formation is restarted in a mono mode or a color mode after the pause. According to information sent from the main controller 10, a rotary rotation control unit 11 in the control unit controls a rotary driving unit so as to move a desired developing device to the developing standby position.

Figure 7:
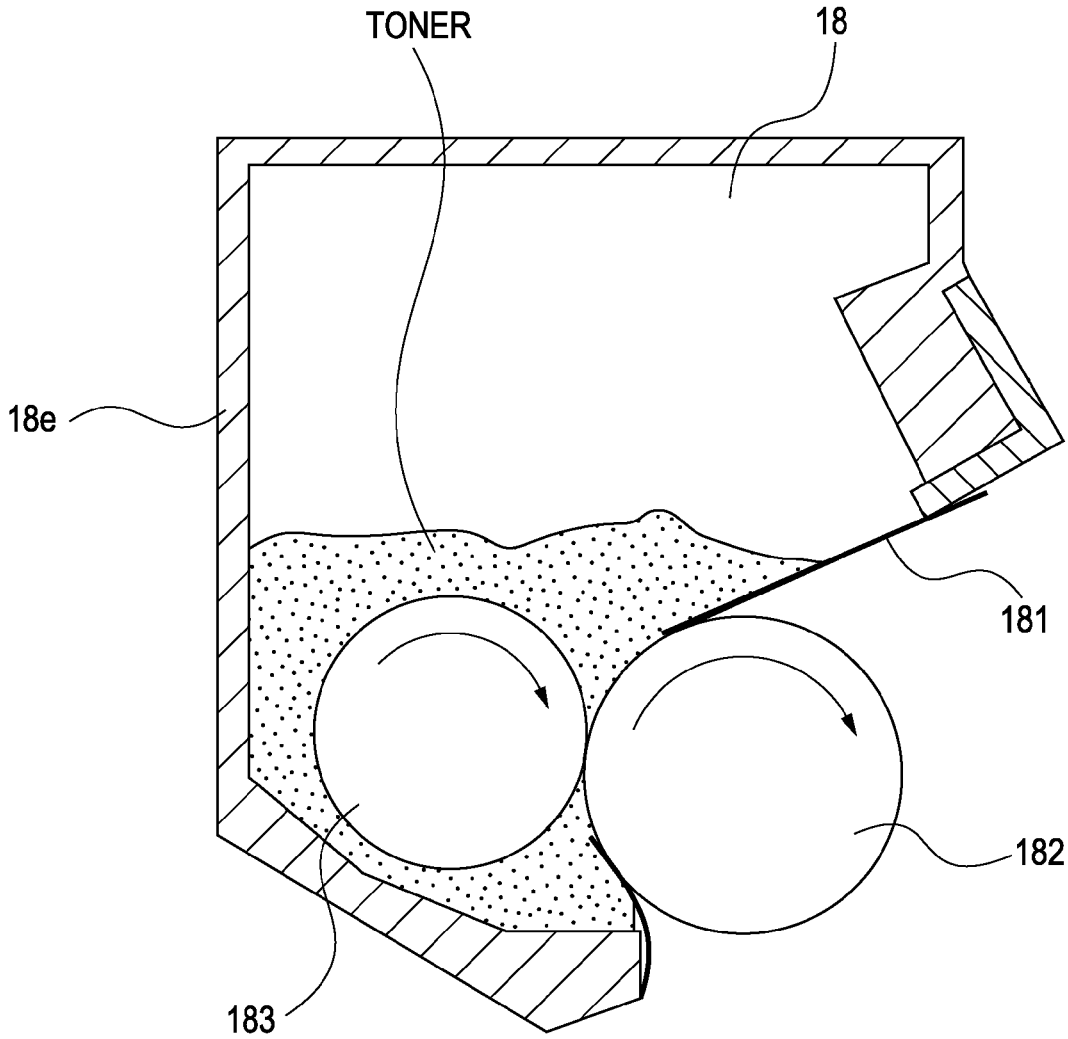
FIG. 7 is a schematic sectional view of a developing device according to the embodiment.

Each developing device of the embodiment has a structure shown in FIG. 7. A developing chamber 18*e* stores toner. A toner supply roller 183 (developing-agent supply member) including a core metal covered with a sponge layer (foam layer) rotates in contact with a developing roller 182 in order to supply toner to the developing roller 182. The developing roller 182 and the toner supply roller 183 rotate in the same direction, and surfaces of the rollers move in opposite directions. With this structure, toner that is not used for development is scraped off, and simultaneously, new toner can be supplied. The supplied toner is uniformly coated on the developing roller 182 by a regulating blade 181.

Figure 8:
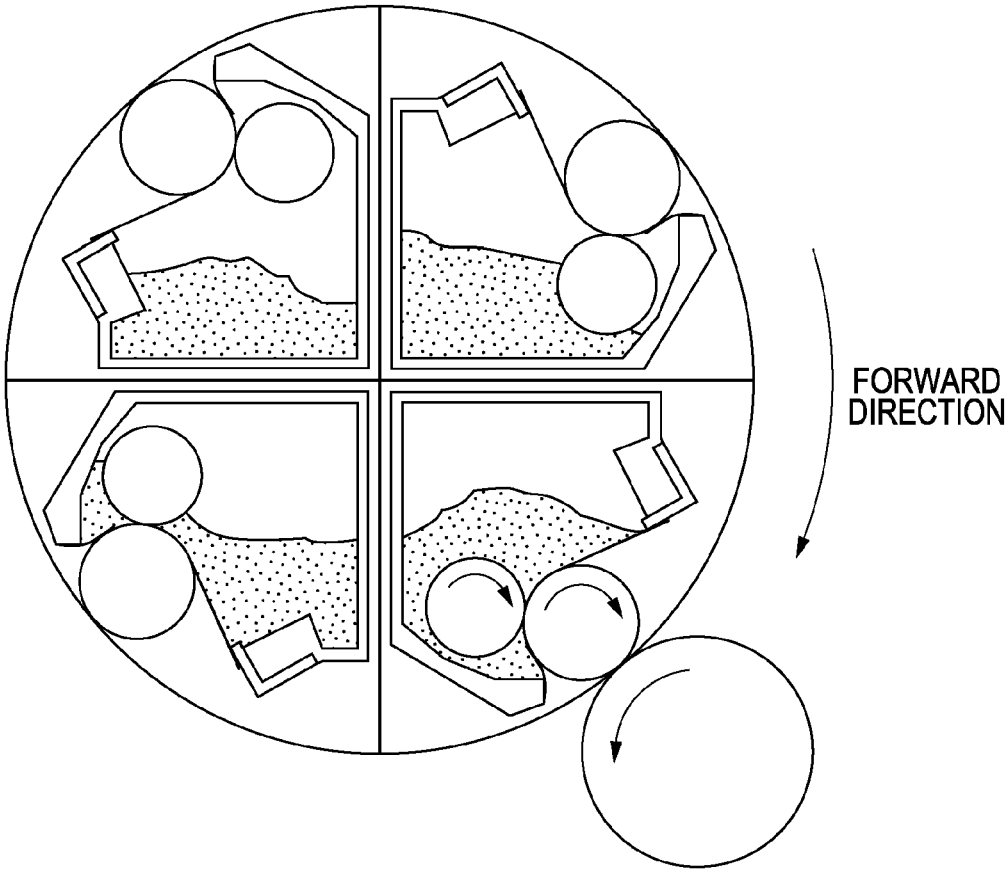
FIG. 8 is a schematic view illustrating motion of toner in developing devices during forward rotation of the rotary.

Normally, toner is supplied to the developing roller by rotating the rotary forward, as shown in FIG. 8. Since the developing device makes one rotation when the developing device is moved to the developing standby position by forward rotation, the toner in the developing chamber is supplied to the supply roller by the rotation of the developing device. However, when the developing device is moved to the developing position by reverse rotation of the rotary, since it does not make one rotation, and therefore, the toner is sometimes not properly supplied to the toner supply roller. Particularly when the amount of residual toner is small, the toner accumulates on a back side of the regulating blade, but is not supplied to the toner supply roller, which causes a white spot having a low density. This is because the toner supply roller sucks the toner from below a nip between the toner supply roller and the developing roller and discharges the toner from above the nip. Consequently, the toner on the downstream side of the nip between the toner supply roller and the developing roller gradually accumulates onto the back side of the regulating blade from above the nip. While the amount of toner is large, the toner above the nip can move below the nip again, this circulation is stopped when the amount of toner decreases.

Figure 9:
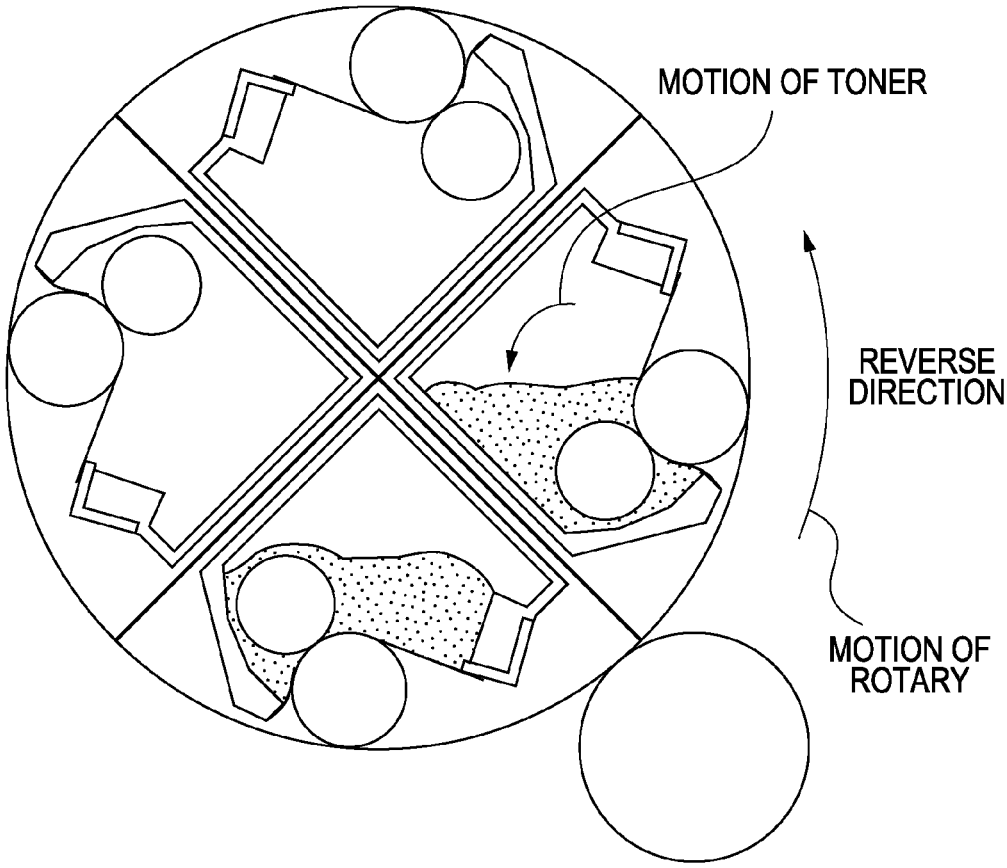
FIG. 9 is a schematic view illustrating motion of the toner in the developing devices during reverse rotation of the rotary.

In view of the above-described problems, at the developing standby position, the developing device of the embodiment assumes a posture such that the toner in the developing chamber moves toward the toner supply roller by gravity, as shown in FIG. 9. By thus supplying the toner toward the toner supply roller, the developing roller can contain a sufficient amount of toner. When the developing device assumes this posture once before moving to the developing position, the toner can be supplied to the toner supply roller without rotating the rotary one turn.

In the rotary standby state of the embodiment, driving force is not input to any of the developing rollers of the developing devices. In this case, even when the photosensitive drum and the intermediate transfer belt are being driven, the developing rollers do not rotate, which can reduce wear of the developing devices.

Thus, at the developing standby position of the embodiment, the driving force is not reliably transmitted to the developing devices (a driving transmission unit is in a separate state). Further, the developing devices assume a posture such that the toner in the developing chamber, especially, the toner accumulating on the developing roller and the back side of the regulating blade fall toward the toner supply roller under its own weight. This reliably suppresses wear of the developing device and occurrence of a white spot, and reduces the above-described rotary moving time.

In the embodiment, the developing roller is brought into contact with the photosensitive drum in the tangential direction of the photosensitive drum by rotating the rotary. Hence, the developing roller can be moved into contact with and away from the photosensitive drum without using any special actuator for separating the developing roller in the tangential direction, and this achieves size reduction. Unfortunately, with this structure, every time the developing device is moved to the position opposing the photosensitive drum by rotating the rotary, it comes into contact with the photosensitive drum. For this reason, there is a fear that fogging and wear of the developing roller or the photosensitive drum will occur. Accordingly, unnecessary contact between the developing roller and the photosensitive drum can be suppressed by minimizing the rotation of the rotary, as described above, and this increases the service life.

In addition, when the rotation of the rotary is reduced, operating noise due to rotation of the rotary can be reduced, that is, noise reduction is achieved.

While the embodiment adopts the rotary that is rotatable in both the forward and reverse directions, the present invention is also applicable to a rotary that is rotatably only in a forward direction. Even in such a rotary capable of rotating only forward, the developing device to be used in the next image formation can be quickly moved to the developing position at a restart of image formation after a pause.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-064678 filed Mar. 17, 2009 and No. 2010-039004 filed Feb. 24, 2010, which are hereby incorporated by reference herein in their entirety.

What is claimed is:

1. An image forming apparatus comprising:

an image bearing member;

a plurality of developing devices each having a developing-agent bearing member bearing developing agent, and each configured to develop an electrostatic latent image formed on the image bearing member, the plurality of developing devices including, a first developing device, and a second developing device configured to perform development in a color different from a color of the first developing device;

a rotatable developing-device support body configured to support the developing devices, the developing-device support body rotating to move the developing devices to a developing position opposing the image bearing member and a developing standby position, the developing standby position being provided between the developing position where a certain developing device is placed and a position where a developing device to be used in the next image formation is placed when a certain developing device is placed at the developing position;

a mode determining unit configured to determine whether the next image formation is performed in a monochromatic mode or a multicolor mode if continuous image formation is paused by moving at least one of the plurality of developing devices away from the developing position, wherein, when the next formation is in the monochromatic mode, development is performed only with the first developing device, and wherein, when the next formation is in the multicolor mode, development is performed with the first developing device after being performed with the second developing device; and a rotation control unit configured to control rotation of the developing device support body before the start of the next formation and while the continuous image formation is paused, wherein, if the mode determining unit determines the next image formation is performed in monochromatic mode, the rotation control unit rotates the developing-device support body so that the first developing device is placed at the developing standby position, and wherein, if the mode determining unit determines the next image formation is performed in multicolor mode, the second developing device is placed at the standby position.

2. The image forming apparatus according to claim 1, wherein the rotation of the developing-agent support body is switched between a forward rotation and a reverse rotation in a direction opposite the forward rotation so as to reduce an amount by which the developing-agent support body rotates to the developing standby position when the continuous image formation is stopped.

3. The image forming apparatus according to claim 1, wherein, when any of the developing devices is placed at the developing standby position, a driving force is input to none of the developing devices.

4. The image forming apparatus according to claim 1, wherein the developing devices each include a developing chamber configured to contain the developing agent and a developing-agent supply member configured to supply the developing agent to the developing-agent bearing member, the developing-agent supply member having a foam layer, and wherein the developing standby position is a position such that the developing agent in the developing chamber moves to the developing-agent bearing member under own weight thereof.

5. The image forming apparatus according to claim 1, wherein the developing-agent bearing member comes into contact with the image bearing member at the developing position, and wherein contact and separation of the developing-agent bearing member and the image bearing member are performed by the rotation of the developing-device support body.

* * * * *